US005718074A

United States Patent [19]

Keeney

[11] Patent Number: 5,718,074

[45] Date of Patent: Feb. 17, 1998

[54] TRIGGER ASSEMBLY

[75] Inventor: Michael D. Keeney, Elizabethtown, Ky.

[73] Assignee: Remington Arms Company, Inc., Madison, N.C.

[21] Appl. No.: 777,262

[22] Filed: Dec. 31, 1996

[51] Int. Cl.[6] ..... F41A 3/00

[52] U.S. Cl. ..... 42/69.03; 42/69.01

[58] Field of Search ..... 42/69.03, 69.01; 89/144, 145, 146

[56] References Cited

U.S. PATENT DOCUMENTS

| | | | |
|---|---|---|---|
| 2,565,688 | 8/1951 | Horan | 42/17 |
| 4,017,996 | 4/1977 | Liedke | 42/69 B |
| 4,152,856 | 5/1979 | Tollinger et al. | 42/69 B |
| 4,308,786 | 1/1982 | Hayashi | 89/144 |
| 4,428,138 | 1/1984 | Seecamp | 42/70 A |
| 5,018,292 | 5/1991 | West | 42/69.02 |
| 5,038,666 | 8/1991 | Major | 89/197 |
| 5,149,898 | 9/1992 | Chesnut et al. | 42/69.01 |
| 5,501,134 | 3/1996 | Milazzo et al. | 89/139 |

*Primary Examiner*—Charles T. Jordan
*Assistant Examiner*—Meena Chelliah
*Attorney, Agent, or Firm*—Huntley & Associates

[57] ABSTRACT

A trigger assembly which allows for recocking a semi-automatic firearm while the trigger is still depressed through a continuous linkage assembly.

7 Claims, 4 Drawing Sheets

TRIGGER ASSEMBLY

BACKGROUND OF THE INVENTION

The present invention relates generally to a trigger assembly for use in a semi-automatic firearm.

In a trigger assembly for a semi-automatic firearm, an important criterion for proper operation is to ensure recocking of the hammer with every cycle of the bolt, regardless of the trigger position. The common terminology of "trigger disconnect" means that once the trigger has been pulled, the cartridge fired and the bolt cycling rearward, the mechanism that disengaged the hammer and sear can return the sear to full engagement with the hammer. Typical semi-automatics cycle faster than one can release the trigger, thus the trigger remains in the pulled or fired condition and if not "disconnected" will not allow the sear to return. Past practice has been to utilize a discontinuous system where the trigger rotation is translated through a number of independent members to the sear. The "disconnect" is achieved by altering the alignment of the members after the hammer is released. To ensure proper functioning of the disconnect process and re-alignment of the members, excessive clearance and large bearing areas are required. Although they do function properly, perceived trigger play, creep and high trigger pull forces are common complaints, and a need accordingly exists for improved mechanisms.

SUMMARY OF THE INVENTION

The present invention provides a trigger assembly which allows the sear to engage the hammer in the cocked position whether or not the trigger has been released and does not exhibit the trigger play, creep and high trigger pull forces of trigger assemblies presently in use.

Specifically, the present invention provides a firing mechanism for a firearm comprising a rotatably mounted trigger, a sear movable between at least engaged and disengaged positions and spring biased toward the engaged position, a hammer movable between at least cocked and fire positions and spring biased toward the fire position, and a bolt slidably mounted in a receiver between at least forward and rearward positions, wherein the trigger is connected to the sear by a continuous linkage assembly having rotatably and hingeally connected front and rear members biased toward an operatively linked horizontal position, the rear member having a disconnect arm positioned to contact the bolt in a rearward position of the bolt, the continuous linkage assembly positioned to transmit a rearward force applied to the trigger to disengage the sear from the hammer and wherein the bolt, when in a rearward position, contacts the disconnect arm causing the front and rear members to rotate, returning the sear to the engaged position where the sear can engage the hammer as the hammer rotates to the cocked position when the bolt moves forward.

DETAILED DESCRIPTION OF THE INVENTION

The present invention will be more fully understood by reference to the drawings, which show specific embodiments of a trigger assembly of the present invention. Variations and modifications of the embodiments shown can be substituted without departing from the principles of the invention, as will be evident to those skilled in the art.

Figure 3:
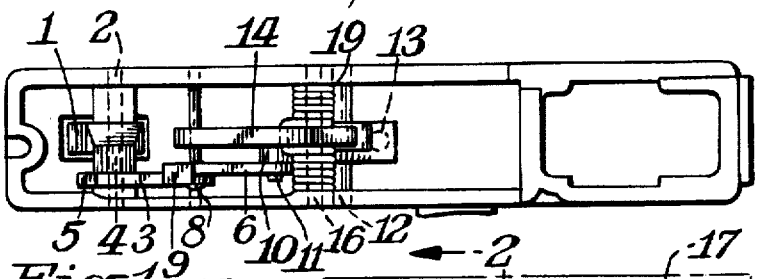
FIG. 3 is a top plan view of a trigger assembly according to the present invention.
Figure 1:
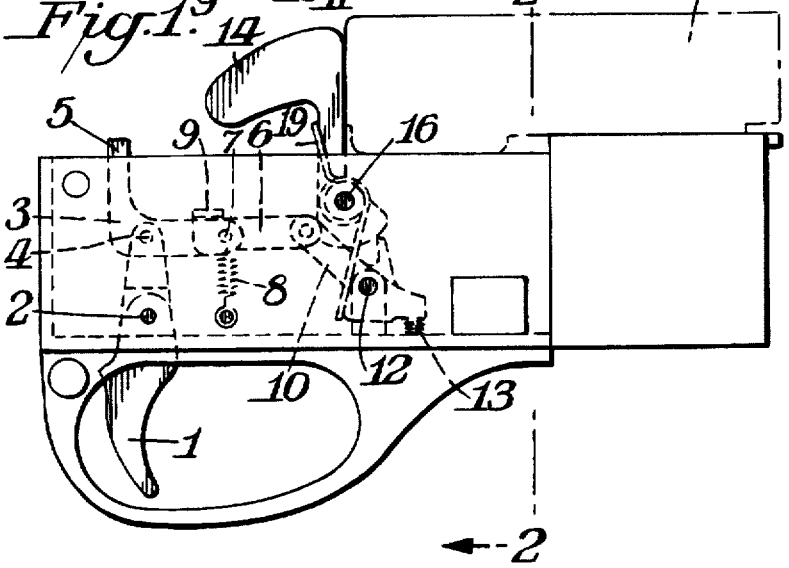
FIG. 1 is a side elevational view of a trigger assembly according to the present invention.
Figure 2:
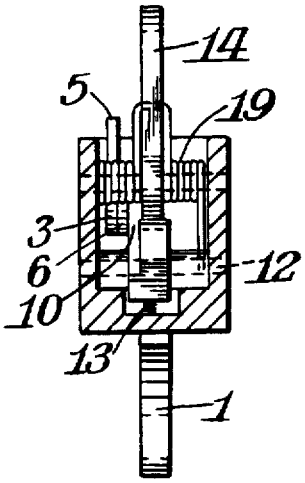
FIG. 2 is a fight side elevational view in cross section of a trigger assembly according to the present invention, taken along line 2—2 of FIG. 1.

FIGS. 1–3 are various views of a trigger assembly according to the present invention. In those Figures, trigger 1 is rotatably connected to the housing by trigger pivot pin 2. Rear link 3 in connected to the trigger 1 by rear link pin 4. Rear link 3 is provided with a disconnect 5 which is an upwardly extending arm located rearward of rear link pin 4. The disconnect can also be provided as a separate element attached to rear link 3. The disconnect is positioned to interrupt the rearward motion of the bolt. Preferably, the disconnect is positioned to intersect the path of the bolt at its rearwardmost position.

Rear link 3 is connected to front link 6 by middle link pin 7. Middle link pin 7 is connected to the housing by link return spring 8, which urges middle link pin 7 and the connected ends of rear link 3 and front link 6 downward. Front link 6 is provided with wrapover tab 9 which contacts rear link 3 rearward of middle link pin 7 when rear link 3 and front link 6 are aligned horizontally. Wrapover tab 9 prevents the connected ends of rear link 3 and front link 6 from moving downward past a position of horizontal alignment.

Front link 6 is connected to sear 10 by front link pin 11. Sear 10 is rotatably connected to the housing by sear pivot pin 12. One end of sear spring 13 is attached to sear 10 forward of sear pivot pin 12, and the other end of sear spring 13 is connected to the housing. Sear spring 13 biases sear 10 to the engaged position where it can engage hammer 14. Hammer 14 is rotatably connected to the housing by hammer pivot pin 16. Bolt 17 is shown in the forward position.

Figure 4:
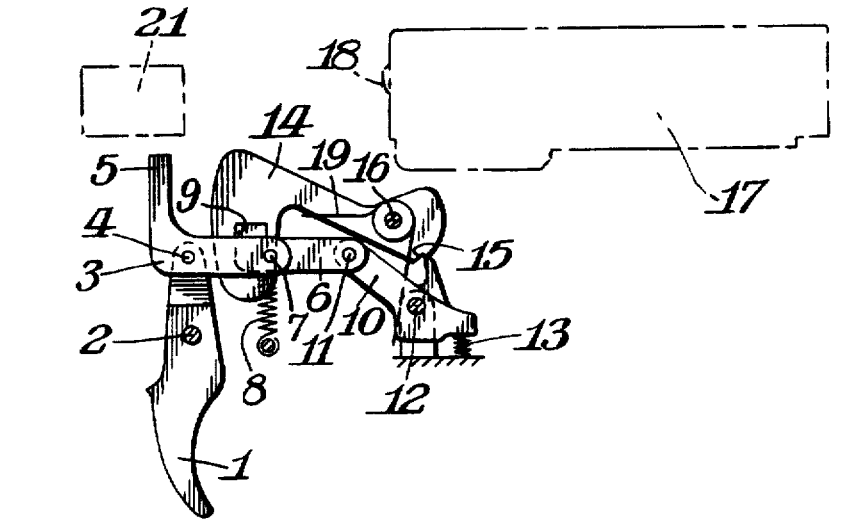
FIGS. 4–10 are schematic diagrams of a trigger assembly according to the present invention during a typical firing cycle.

FIG. 4 shows the trigger assembly in the ready-to-fire position. Hammer 14 is engaged by sear 10 at hammer notch 15, thereby restraining hammer 15 from rotating toward firing pin 18 under the force of hammer torsion spring 19. bolt 17 is in the forward position.

Figure 5:
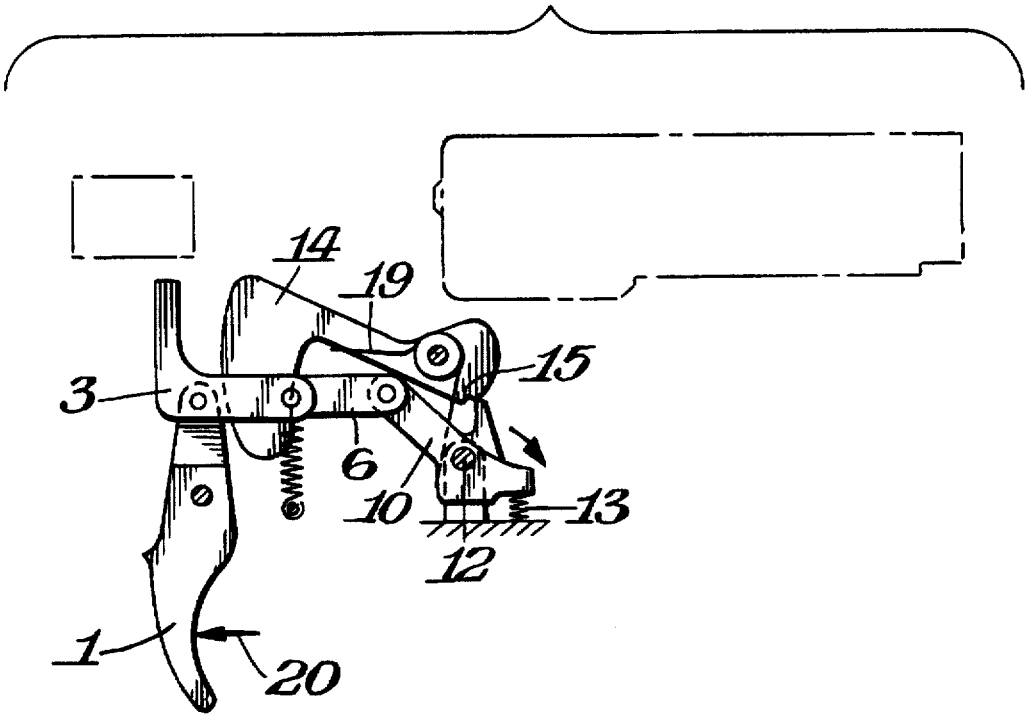

FIG. 5 shows the beginning of the firing sequence. A rearward force, shown by arrow 20, is applied to trigger 1. This force is translated into a forward movement of rear link 3 and from link 6, which are in the aligned position, causing sear 10 to rotate about sear pivot pin 12 to a disengaged position. Sear 10 rotates so it is no longer contacting hammer notch 15.

Figure 6:
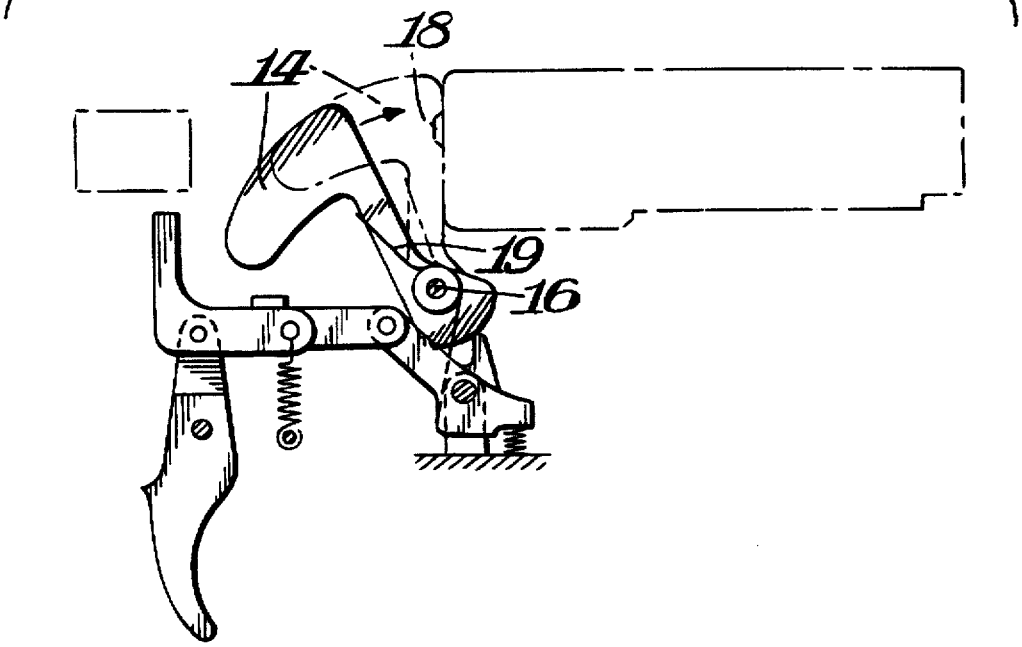

FIG. 6 shows hammer 14 rotating about hammer pivot pin 16 toward the fire position due to the biasing of hammer torsion spring 19 which is attached to hammer 14 and hammer pivot pin 16. As shown in FIG. 6 in phantom lines, hammer 14 continues to rotate about hammer pivot pin 16 until hammer 14 strikes firing pin 18. When firing pin 18 is struck, it causes a round of ammunition (not shown) to fire.

Figure 7:
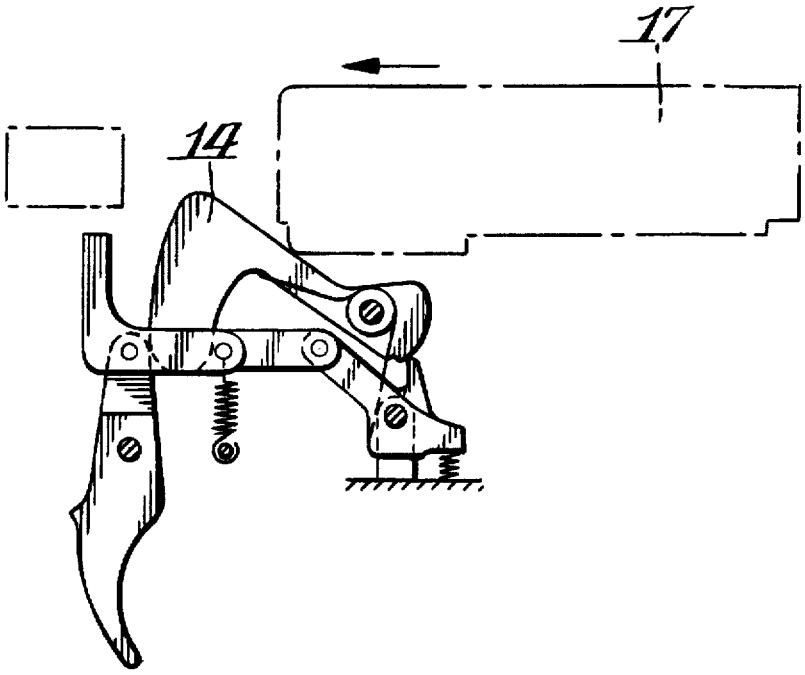

FIG. 7 shows bolt 17 moving toward its rearward position after the round has fired. This rearward motion of bolt 17 is the result of the firing of the round. As bolt 17 moves rearward, hammer 14 is contacted by bolt 17 and is rotated toward the cocked position.

Figure 8:
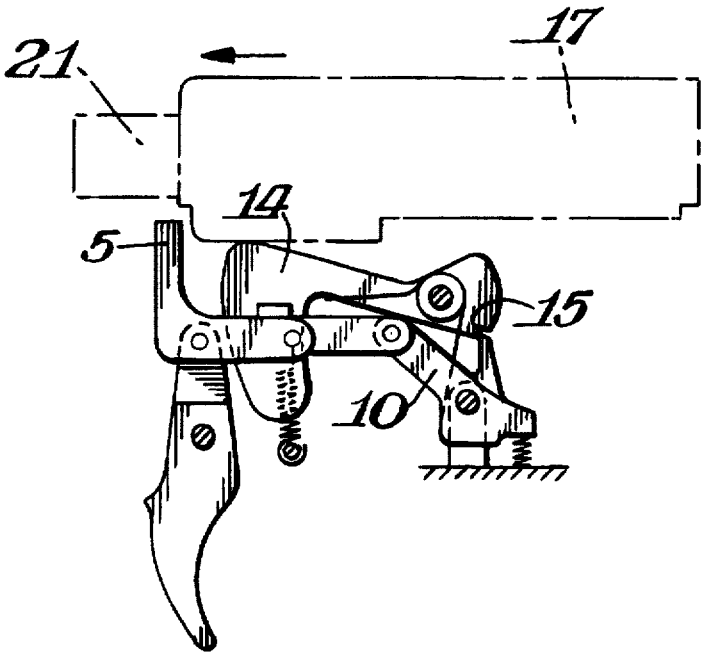

FIG. 8 shows bolt 17 as it is about to contact disconnect 5 of rear link 3. At this point in the firing cycle, sear 10 is not in its engaged position where it can contact hammer notch 15. Bolt 17 continues to move rearward until it contacts disconnect 5 and, subsequently, bolt stop 21.

Figure 9:
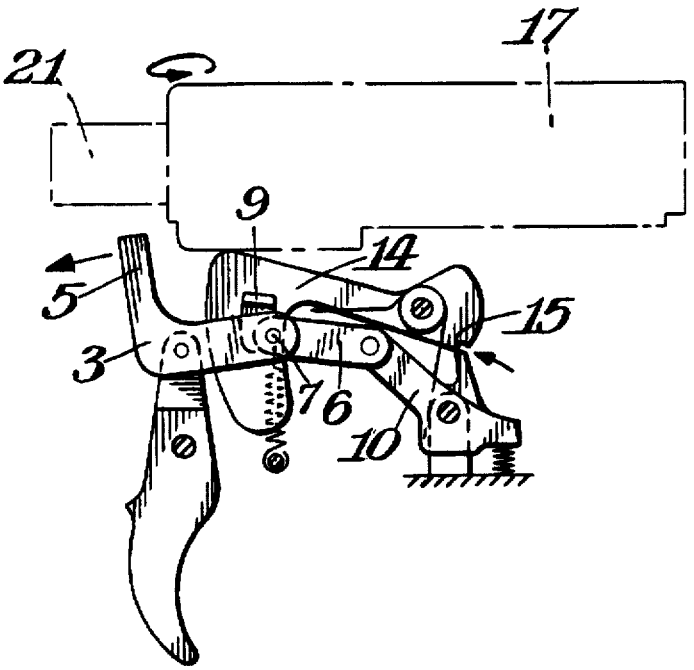

FIG. 9 shows the trigger assembly after bolt 17 has contacted disconnect 5, and bolt 17 is moving forward. The forward motion of bolt 17 is provided by bolt springs (not shown) which bias bolt 17 toward the forward position. The contact between bolt 17 and disconnect 5 causes middle link pin 7 to move upward, thereby moving rear link 3 and front link 6 to the unaligned position. This "breaking" of the links allows sear 10 to rotate to the engaged position.

Figure 10:
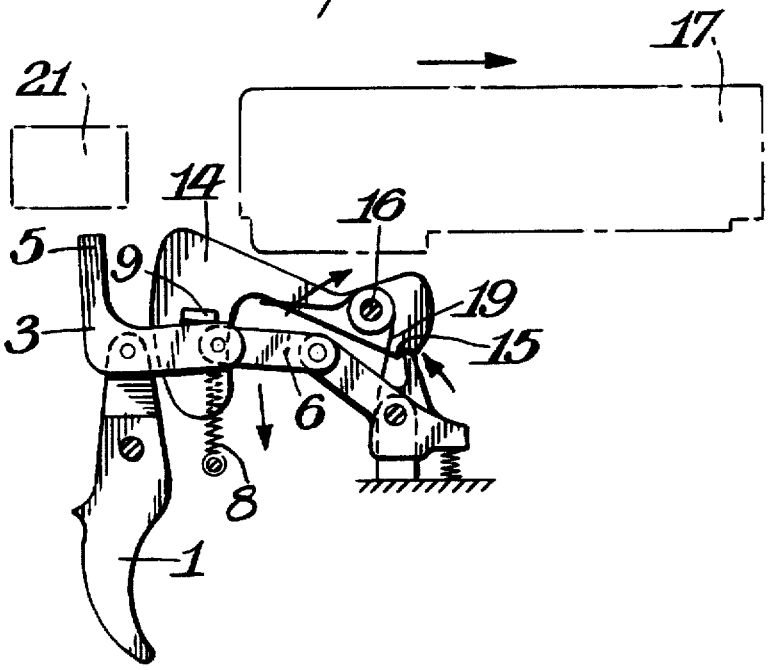

In FIG. 10, bolt 17 continues to move toward the forward position, allowing hammer 14 to rotate about hammer pivot pin 16 to its cocked position until sear 10 contacts hammer notch 15. When the rearward force on trigger 1 is released, link return spring 8 urges middle link pin 7 downward, moving rear link 3 and front link 6 toward the aligned position until wrapover tab 9 on from link 6 contacts rear link 3, thereby preventing further downward movement of middle link pin 7. Once bolt 17 moves to its forward position, the trigger assembly is in the ready-to-fire condition as shown in FIG. 4.

The firing mechanism of the present invention, through the continuos linkage between the trigger and the sear, results in lower perceived trigger play, creep and trigger pull forces.

I claim:

1. A firing mechanism for a firearm comprising a rotatably mounted trigger, a sear movable between at least engaged and disengaged positions and spring biased toward the engaged position, a hammer movable between at least cocked and fire positions and spring biased toward the fire position, and a bolt slidably mounted in a receiver between at least forward and rearward positions, wherein the trigger is connected to the sear by a continuous linkage assembly having rotatably and hingedly connected front and rear members movable between at least aligned and unaligned positions and spring biased toward the aligned position, the rear member having a disconnect arm positioned to contact the bolt in a rearward position of the bolt, the continuous linkage assembly positioned to transmit a rearward force applied to the trigger to disengage the sear from the hammer and wherein the bolt, when in a rearward position, contacts the disconnect arm causing the front and rear members to move to the unaligned position, returning the sear to the engaged position where the sear can engage the hammer as the hammer rotates to the cocked position when the bolt moves forward, and wherein the front and rear members move to the aligned position when the rearward force is removed from the trigger.

2. A firing mechanism of claim 1, wherein the hammer further comprises a hammer notch which the sear engages when the sear is in the engaged position to retain the hammer in the cocked position.

3. A firing mechanism of claim 1 wherein the front member further comprises a wrapover tab positioned to contact the rear member and prevent the front and rear members from moving downward past the aligned position.

4. A firing mechanism of claim 1 wherein the front and rear members are connected by a link pin.

5. A firing mechanism of claim 4 wherein the link pin is spring biased to move the front and rear members to the aligned position.

6. A firing mechanism of claim 1 wherein the disconnect arm is positioned to contact the bolt in the rearwardmost position of the bolt.

7. A firing mechanism of claim 1 wherein the disconnect is integral with the rear member of the linkage assembly.

* * * * *